United States Patent [19]

McElvany

[11] Patent Number: 4,781,031

[45] Date of Patent: Nov. 1, 1988

[54] FROST REDUCER FOR REFRIGERATED CABINET

[76] Inventor: Billy L. McElvany, 3540 W. Pioneer Pkwy., Arlington, Tex. 76013

[21] Appl. No.: 71,276

[22] Filed: Jul. 8, 1987

[51] Int. Cl.[4] ..... A47F 3/04

[52] U.S. Cl. ..... 62/255; 62/272

[58] Field of Search ..... 62/272, 353, 255

[56] References Cited

U.S. PATENT DOCUMENTS 3,177,678 4/1965 Facey, Jr. ..... 62/272
3,858,408 1/1975 Kenyon ..... 62/272 X
4,019,339 4/1977 Anderson ..... 62/255
4,603,558 8/1986 McAdams ..... 62/272

*Primary Examiner*—Lloyd L. King
*Attorney, Agent, or Firm*—Anthony A. O'Brien

[57] ABSTRACT

A refrigerated cabinet for the merchandising of frozen foods is disclosed as including a lower interior freezer and an upper opened top which is provided with a peripheral mount; a frost shield carried by the mount is located in spaced relation and adjacent to walls of the freezer whereby frost accumulates on the frost shield rather than on the freezer walls.

6 Claims, 2 Drawing Sheets

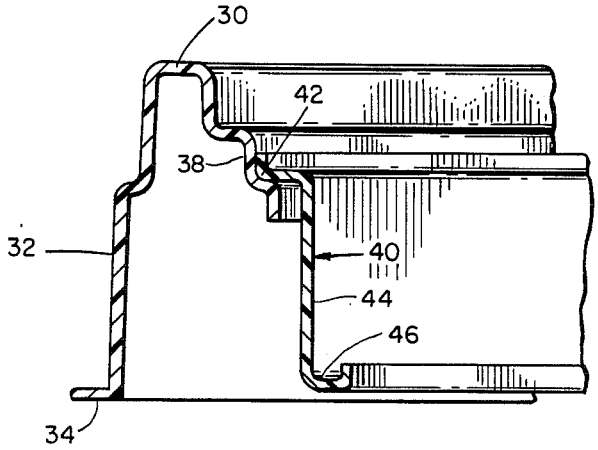
FIG. 2.
FIG. 3.
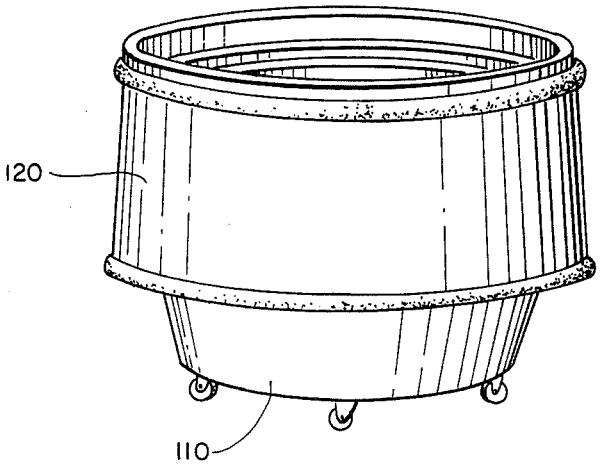

FROST REDUCER FOR REFRIGERATED CABINET

BRIEF SUMMARY OF THE INVENTION

The present invention relates to refrigerated cabinets of the type having an open top portion to provide easy access to frozen foods therein. Such conventional refrigerated cabinets are faced with the problem of requiring frequent defrosting because the ambient warm air is drawn into the cabinet by the turbulence of the cold air therein; this arrangement results in frost forming on the evaporator wall of the cabinet and thus acting as an insulator to lower the temperature of the evaporator wall.

It is an object of the present invention to solve the frost accumulation problem of a refrigerated merchandising cabinet by retarding the frost accumulation with a frost shield.

It is another object of the present invention to locate a frost shield in the upper portion of a refrigerated cabinet in spaced relation to the evaporator wall of the freezer unit.

A further object of this invention is to maintain a frost shield and the wall of a freezer's evaporator in a refrigerator cabinet at substantially the same temperatures.

It is another object of this invention to stabilize the cold air in the food freezer chamber of a refrigerated cabinet.

The present invention has another object in that the flow of ambient warm air is reflected away from the food freezer chamber of a refrigerated cabinet.

It is a further object of the present invention to substantially reduce the flow of warm air into the food freezer chamber of a refrigerated cabinet.

The present invention is summarized in that a frost shield for a refrigerated cabinet is located adjacent the upper portion of the cabinet's food freezer chamber so that frost and/or ice will form on the frost shield and not on the evaporator wall forming the freezer chamber; the frost shield is mounted in spaced relation to the evaporator wall whereby the ambient warm air will conically rise above the freezer chamber and will not be drawn into the freezer chamber.

Other objects and advantages will become apparent from the following description taken in conjunction with the drawings.

BRIEF DESCRIPTION OF THE DRAWINGS

FIG. 2 is a fragmentary cross sectional view of a detail of FIG. 1 but shown on an enlarged scale and with the frost shield in assembled position.

FIG. 3 is a perspective view of a refrigerator cabinet similar to FIG. 1 but showing the cabinet to be a round tub-like configuration.

DETAILED DESCRIPTION

Figure 1:
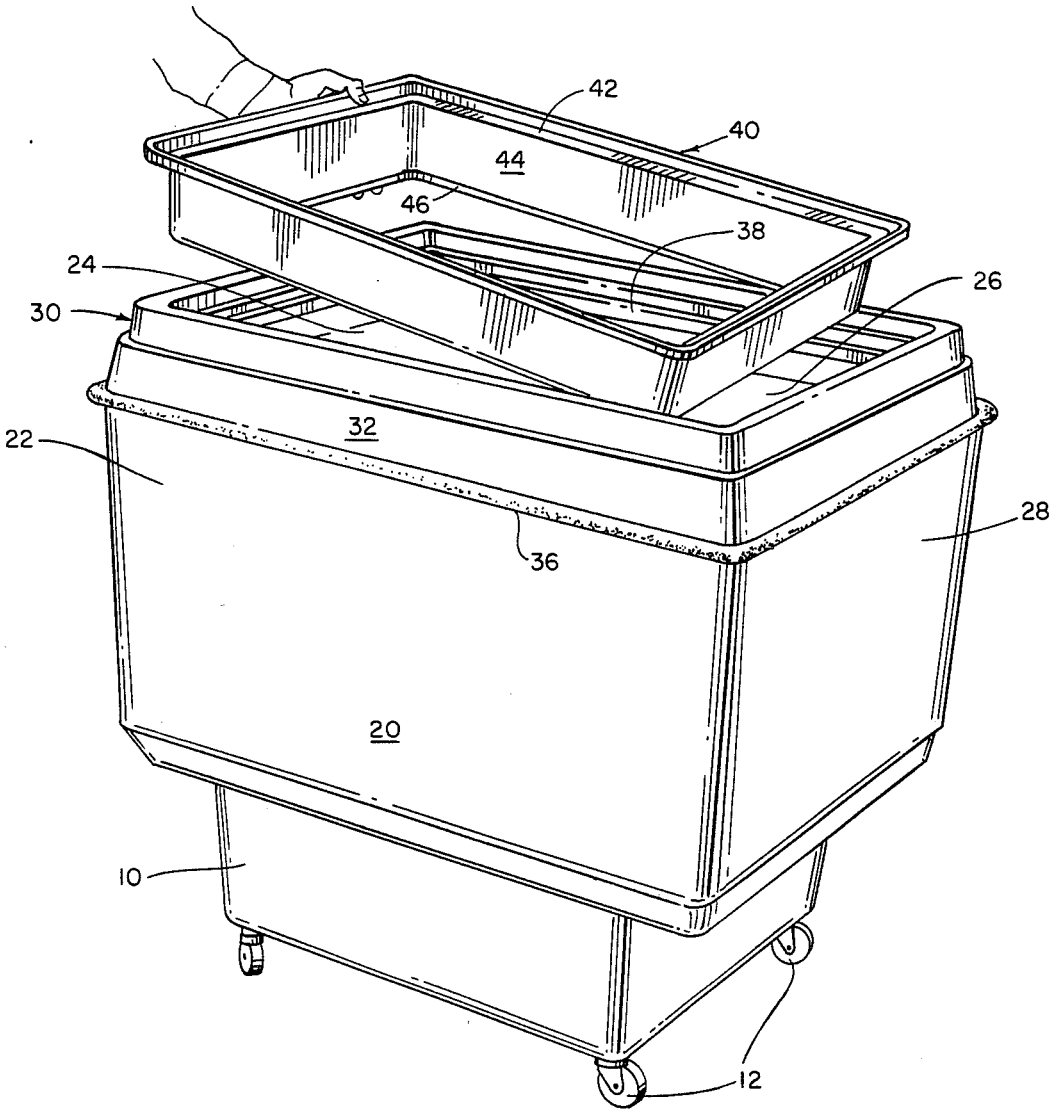
FIG. 1 is a perspective view of a refrigerated cabinet for frozen foods embodying the frost shield of the present invention.

As is illustrated in FIG. 1, a base 10 having four casters 12 (only three being shown) defines a movable support for a refrigerated cabinet, indicated generally at 20. As is shown in FIG. 2, the refrigerated cabinet is rectangular in plan view, however, the shape may be varied to conform to particular requirements; for example, a circular cabinet 120 is shown in FIG. 3 on a circular base 110. It is to be understood that other shapes may be utilized such as triangular, square, trapezoidal, as well as irregular shapes to conform to installation requirements.

The refrigerated cabinet 20 has a bottom wall integrally formed with four hollow walls 22, 24, 26 and 28 perpendicular thereto so that the cabinet is open at its top.

The top portion of the cabinet 20 includes a generally inverted U-shaped member 30 (see FIG. 2) with a pair of vertical walls horizontally spaced from each other. One wall 32 has a lower flange 34 which may be supported on the cabinet wall 22 (24, 26 and 28) with a rubber-like bumper sealing ring 36 thereon. The second wall 38 has a stepped portion 38 which is disposed on the wall of the evaporator of the freezer unit. The inside of the stepped portion 38 defines a peripheral support for an open frame element 40.

It should be noted that the wall 32, the lower flange 34 and the stepped support 38 conform to the entire perimeter of the upper portion of the cabinet 20 to define the continuous perimeter of the inverted U-shaped member 30.

The frame 40, which defines a frost shield, is shown in FIG. 2 as includes a L-shaped ledge 42 which is supported on the inside of the stepped portion 38. A vertical wall 44 extends from the upper ledge 42 to a lower U-shaped channel 46. The components 42, 44 and 46 also conform to the entire perimeter of the upper portion of the cabinet 20.

While the inverted U-shaped member 30 has been described above as a separate structure supported on the cabinet 20, the member 30 may be integrally formed with the cabinet 20. In such an arrangement, the lower part of the stepped portion 38 would be integral with the evaporator wall 48.

The horizontal dimension of the upper ledge 42 is approximately twice that of the mating horizontal dimension of the supporting stepped portion 38. Consequently, the frame's vertical wall 44 is horizontally spaced inwardly from the lower part of the stepped portion 38 and the evaporator wall 48. In addition, it is apparent from FIG. 2 that the stepped arrangement locates the frost shield 40 slightly from the top surface U-shaped member 30.

The frost shield 40 may be made of any suitable material light enough to be inserted and removed by hand from the cabinet 20. In the particular arrangement shown the material utilized is a molded plastic, but other suitable materials such as metal, wood, etc. may also be utilized.

The refrigerated merchandiser is a conventional item available in the open market, for example, Models AS-4.5, AS-6, AS-8, AS-7, PL-3 and RD-8 manufactured by ARTIC STAR OF TEXAS in Arlington, Tex. The conventional refrigerated merchandiser includes the common items of a freezer unit, such as a 115 volt, one-half horsepower compressor, an evaporator and a thermostatic control device.

The frost shield's purpose is to eliminate the majority of frost and ice from accumulating on the evaporator wall of the freezer unit. This is done by placing the frost shield at the top area of the freezer. The design of the shield causes the cold air to become very stable in the freezing chamber. This is done by reflecting the warm air in an upward motion which forms a cone effect over the opening of the freezing chamber by eliminating the air turbulence. This helps in eliminating the intake of warm moist air. The location of the frost shield from the top edge of the unit and the clearance from the evaporator wall allows the frost shield to become approximately the same temperature as the evaporator wall. This allows the frost and ice to accumulate on the shield and not on the evaporator.

Usually a cold wall freezer needs to be defrosted at least every four to five days to make it operate effectively, because the ice and frost acts as an insulator. The frost shield allows the unit to operate at a much longer period of time, approximately two to three weeks before the frost and ice affect the temperature. The frost shield can be made either as a removable part or as a permanent part of the unit. If it is a separate part, the ice and frost can be disposed of by either tapping the frost shield and knocking the frost and ice off, or flushing it with water. If the shield is a permanent part of the unit, the ice and frost can be removed by tapping the shield with your hand, or some instrument, to break it loose from the shield and then dispose of it.

During operation of the above described refrigerated unit, the warmer ambient air surrounding the open top of the unit is deflected upwardly adjacent the periphery of the cabinet causing a cone effect to be formed over the freezer compartment. Thus, there is a substantial reduction of the warmer air flow into the freezer compartment and a consequential mixing with the cooler air therein whereby turbulence of the cooler air is substantially reduced. The deflector element 40 is located in the upper area of the freezer compartment and in spaced relation to adjacent vertical wall portions with the result that the ice and frost will accumulate on the deflector and not on the wall portions of the freezer compartment.

Inasmuch as the present invention is subject to many modifications, changes in details and reversal of parts, it is intended that all matters contained in the foregoing description or shown in the accompanying drawings shall be interpreted as illustrative and not in a limiting sense.

I claim:

1. A cabinet for merchandising frozen foods comprising vertical wall means defining a freezer compartment in said cabinet, means defining an opening adjacent to portions of said wall means, an open frame in said opening and having upper and lower opened portions in registry with said opening, said frame including a wall extending between said upper and lower portions and a mounting ledge of said wall adjacent said upper opened portion, said wall being spaced from said wall means whereby frost will accumulate on said wall and frost will be reduced on said wall means, said ledge being supported on the adjacent top portions of said vertical wall means, and said wall including a peripheral channel adjacent said lower opened portion.

2. A cabinet as claimed in claim 1 wherein said vertical wall means defines a rectangular outline.

3. A cabinet as claimed in claim 1 wherein said vertical wall means defines a circular outline.

4. A cabinet for merchandising frozen foods comprising a top opening for said cabinet, a perimeter element disposed peripherally adjacent the top opening of said cabinet, an outside wall member on said perimeter element, inside step means on said perimeter element extending away from said outside wall member, a frame element disposed inside said perimeter element, ledge means on said frame element adjacent its top area and engaging said step means, thereby causing the frame element to be supported on said perimeter element in spaced relation to said outside wall member, and said frame element causing ambient warm air to flow conically upwardly away from said perimeter element to reduce frost accumulation on said perimeter element.

5. A method for shielding frost accumulation on a refrigerated cabinet having a lower interior containing cold air for food products and an upper open top comprising the steps of reflecting warm air flow upwardly away from the open top of said refrigerated cabinet, said reflecting step occurring about said open top at its periphery, said reflected warm air forming a cone effect over said open top whereby the cold air is substantially stabilized causing substantial reduction of turbulence in the lower interior of said refrigerated cabinet.

6. A method for reducing frost accumulation in a refrigerated cabinet having a lower freezer chamber and an upper open top comprising the steps of:

upwardly deflecting warm air flow about the open top adjacent its periphery whereby a cone effect is formed over the freezer chamber causing substantial elimination of air turbulence in the freezer chamber and substantial reduction of warm air flow into the freezer chamber, and spacing a deflector element inwardly from wall portions of the freezer chamber whereby ice and frost accumulates only on the deflector element.

* * * * *